US009826844B1

(12) United States Patent
Miller

(10) Patent No.: US 9,826,844 B1
(45) Date of Patent: Nov. 28, 2017

(54) INTERACTIVE DISPLAY GRIP HOLDER

(71) Applicant: Eaton Corporation, Cleveland, OH (US)

(72) Inventor: Bruce Allan Miller, Pinehurst, NC (US)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 15/155,515

(22) Filed: May 16, 2016

(51) Int. Cl.

| | |
|---|---|
| ***A47G 29/00*** | (2006.01) |
| ***A47F 7/00*** | (2006.01) |
| ***A47F 5/00*** | (2006.01) |
| ***A47F 10/02*** | (2006.01) |

(52) U.S. Cl.
CPC ..... *A47F 7/0021* (2013.01); *A47F 5/0006* (2013.01); *A47F 10/02* (2013.01)

(58) Field of Classification Search
USPC ..... 248/692
See application file for complete search history.

(56) References Cited

U.S. PATENT DOCUMENTS

| | | | | |
|---|---|---|---|---|
| 2,840,896 A * | 7/1958 | Edwards | A63B 53/14 | 29/234 |
| 4,869,304 A * | 9/1989 | Gore | B23D 61/025 | 144/1.1 |
| 4,899,894 A * | 2/1990 | Crump | A47B 81/00 | 211/70.2 |
| 5,738,229 A * | 4/1998 | Fairweather | A63B 55/10 | 211/70.2 |
| 6,298,546 B1 * | 10/2001 | Slota | A63B 60/42 | 29/720 |
| 6,305,655 B1 * | 10/2001 | Van Horn | A47F 5/0006 | 248/301 |
| 6,394,287 B2 * | 5/2002 | Cabrera | A47B 81/005 | 211/104 |
| 6,460,237 B1 * | 10/2002 | Tsiguloff | A63B 53/14 | 29/235 |
| 6,775,891 B1 * | 8/2004 | Tsiguloff | B25B 27/28 | 29/235 |
| 7,963,012 B1 * | 6/2011 | Brasher | A63B 53/14 | 29/244 |

* cited by examiner

*Primary Examiner* — Monica Millner
(74) *Attorney, Agent, or Firm* — Daniel S. Kalka

(57) ABSTRACT

An interactive display holder for a grip includes a backboard with an upper and a lower support. The lower support supports the grip by retaining the grip at its lower end through an opening in the lower end of the grip. The upper support holds the grip through a swivel arm that engages an aperture in the butt end of the grip. While the grip is in the display holder, the grip can be moved away from the holder to allow a prospective customer to handle the grip for feel without opening a package or boxed container. The interactive display holder is particularly suited for handling a golf club grip for the grip feel.

20 Claims, 3 Drawing Sheets

INTERACTIVE DISPLAY GRIP HOLDER

FIELD

The present disclosure relates in general to an interactive display holder for a hand grip, and more particularly to a new and improved interactive display holder for a golf club grip.

BACKGROUND

There are many forms of grips available on the market today for a wide variety of applications. These applications can range from grips for common tools, like hammer handles, or other hand tools, to sports grips for various sport vehicles, and sport implements like tennis, squash, or racquetball rackets, and golf clubs. While the present invention is particularly suited as an interactive display holder for a golf club grip and described with reference thereto, it should be immediately apparent that the present invention is not intended to be limited thereto, but extends to any sports grip or hand grip that is constructed for a slip-on application. By slip-on application, this term means the grip is constructed to slide on to a handle or shaft and is secured thereon.

When golf club grips, that is swing grips or putter grips, are sold, they are often offered for sale in some form of a sealed package or box. That does not lend itself well for the customer who wishes to handle the grip to check its feel and have a closer look at the grip. The feel of the grip and the way it fits in the user's hands are important to a golfer, as well as the look of the grip, and to a customer who plays or works with an implement for that grip. Golfers are particularly knowledgeable about their sport, and what they like or don't like in a grip, how it feels and appears in their game. Their knowledge of the game and personal likes with the appearance and feel of a grip are motivating factors in their purchasing decision for a particular type of golf club grip.

There still exists a need for an interactive grip display holder that allows the customer access to the grip for handling the grip without opening a package or box to check the feel of the grip within the customer's hands and view the overall appearance of the grip. In the event the customer chooses not to purchase the grip, the grip is easily replaced in its original display holder in a presentable form.

BRIEF SUMMARY OF THE DISCLOSURE

The present disclosure is directed to an interactive display holder for a hand grip.

The interactive display holder according to the present disclosure includes a backboard extending lengthwise for receiving a grip. The backboard has a lower support attached at a lower end of the backboard for supporting the lower end of the grip. The backboard also includes an upper support attached at an upper end of the backboard. The upper support includes an arm at one end constructed to swivel and releasably engage an aperture at an upper end of the grip.

The interactive grip display holder of the present disclosure is particularly suited for a golf club grip such as a putter grip.

The various features of novelty which characterize the present disclosure are pointed out with particularity in the claims annexed to and forming a part of this disclosure. For a better understanding and its operating advantages attained with its use, reference is made to the accompanying drawings, and descriptive matter.

DETAILED DESCRIPTION

Figure 1:
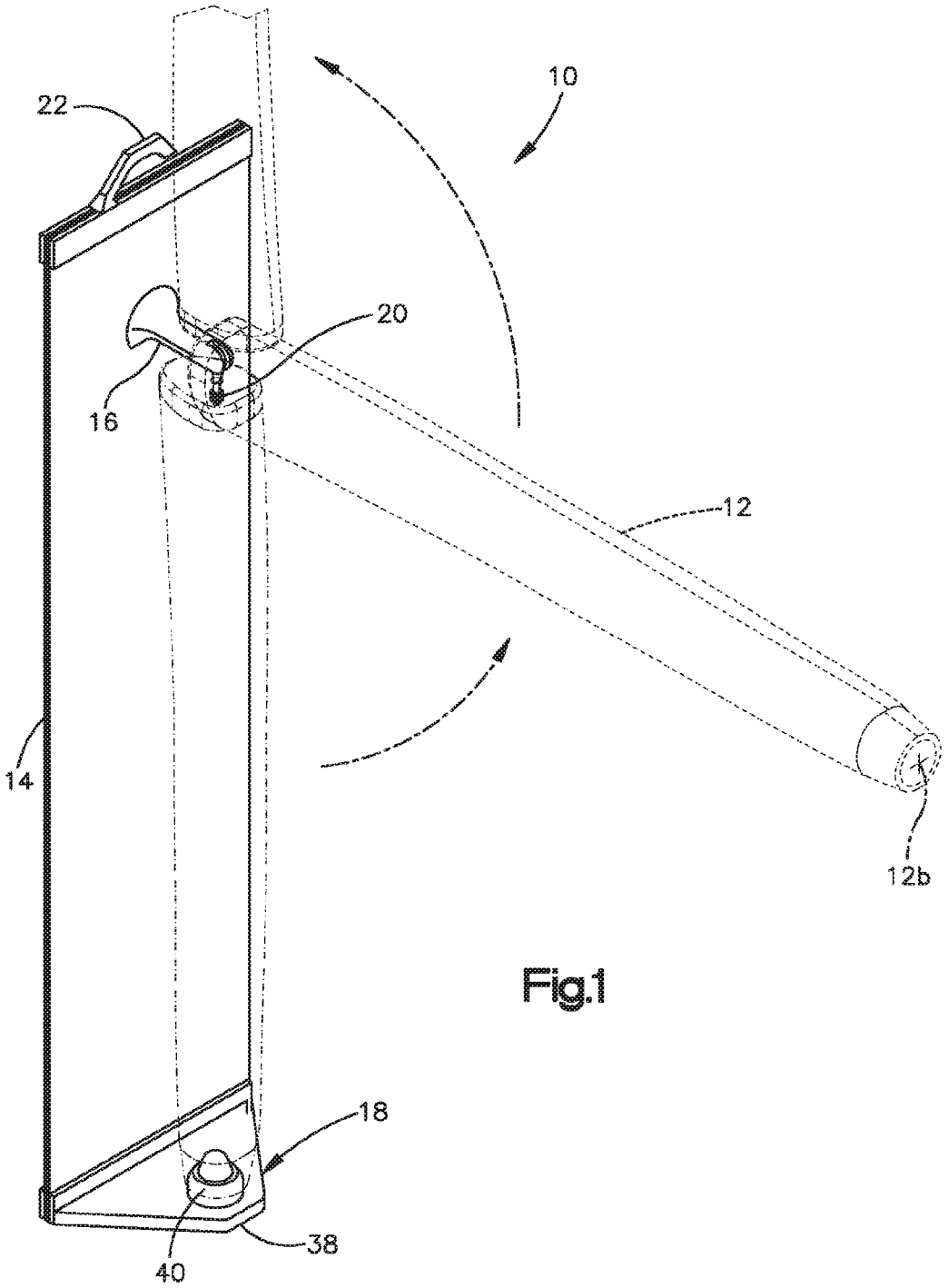
FIG. 1 is an elevated perspective view of an interactive display grip holder according to the present disclosure with a golf club grip shown in phantom line in two positions first resting in the holder and the second capable of being released from the holder for closer examination and grip feel.
Figure 4:
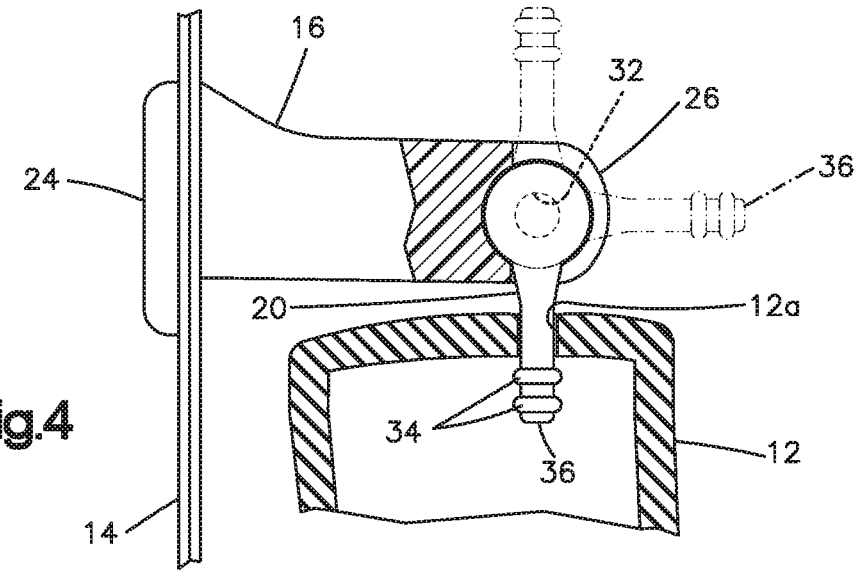
FIG. 4 is a partial sectional side view of the upper portion of the interactive display grip holder retaining a partial sectional side view of the butt end of a golf club grip according to the present disclosure.
Figure 6:
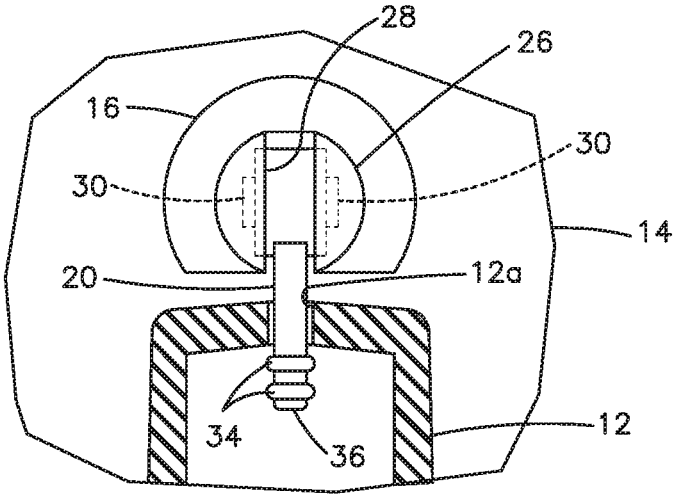
FIG. 6 is a partial frontal view of the upper portion of the interactive display grip holder retaining a partial sectional frontal view of the butt end of a golf club grip according to the present disclosure

Referring to the figures, which are not intended to limit the present disclosure and where like numerals designate like or similar features throughout the several views, and first in particular to FIG. 1, there is shown an interactive display grip holder generally designated 10 retaining a golf club grip 12 (shown in dashed line) such as a putter grip or a swing grip. Golf club grip 12 is held on a backboard 14 by an upper support 16 with an arm 20 engaging an aperture 12*a* in the grip's butt end, as best seen in FIGS. 4 and 6, with the opening 12*b* in the lower or shaft end of the grip 12 resting on a lower support 18. Backboard 14 may be constructed of a cardboard, layered cardboard, fiberboard, or plastic or polymer material, and has sufficient stiffness for holding and supporting the grip 12 which is loosely and releasably held with the upper and lower supports 16, 18. The backboard's width and length are sized according to the length and width of the grip that is intended to be held and displayed. The backboard 14 should leave some room for placement of any trademarks, descriptive material, decorative material or promotional material. Backboard 14 may include a handle or hook 22 at its uppermost end for hanging the holder 10 and grip 12 vertically for display.

Figure 2:
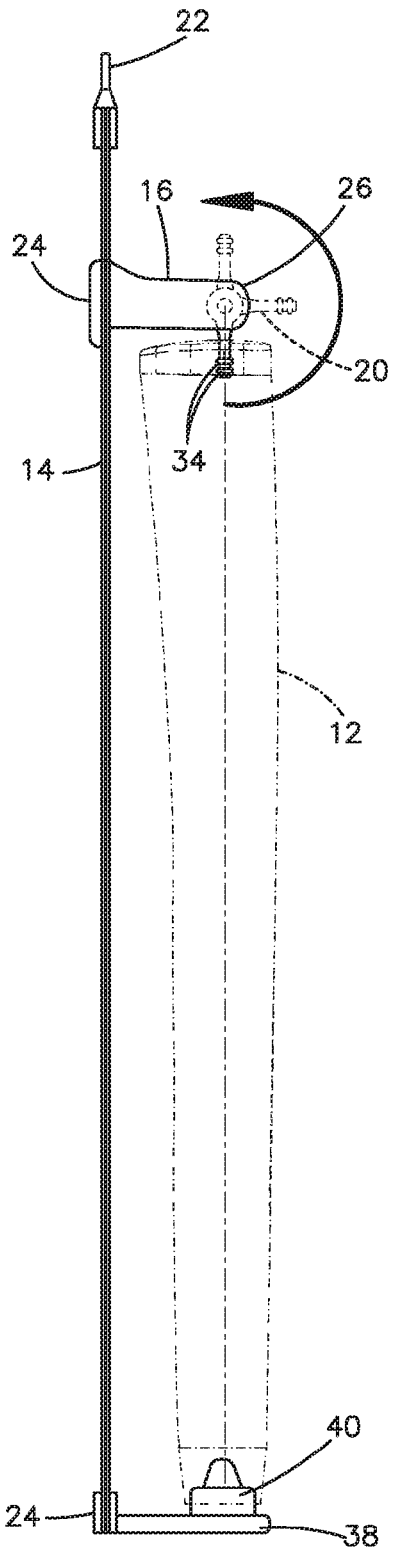
FIG. 2 is a side view of the interactive display grip holder according to the present disclosure.
Figure 3:
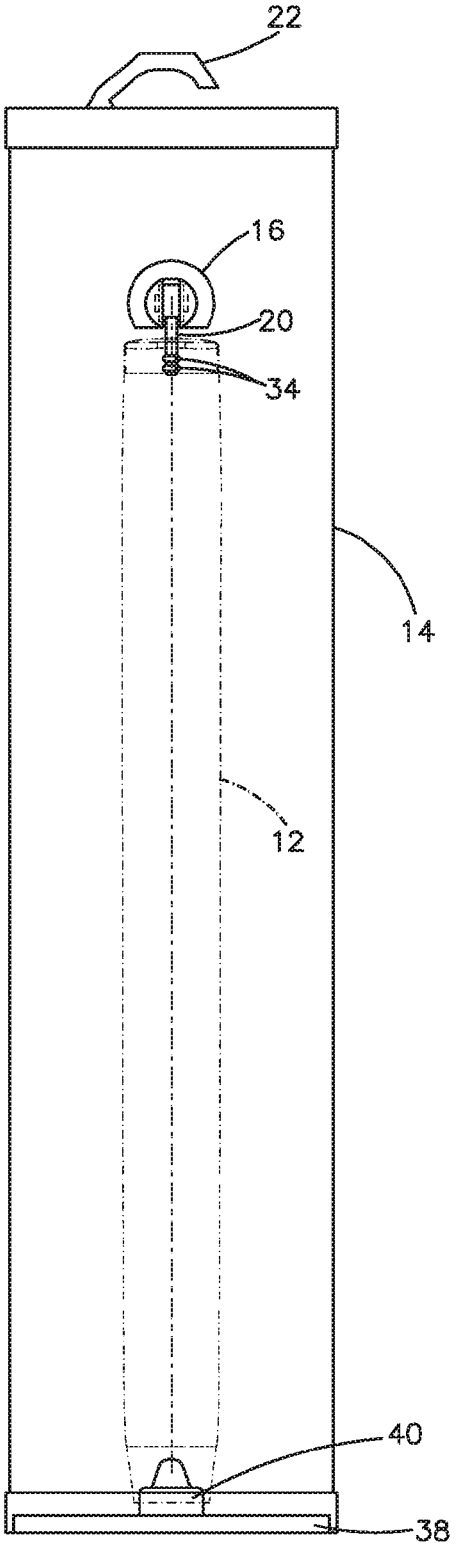
FIG. 3 is a frontal view of the interactive display grip holder according to the present disclosure.

The upper support 16 may be separate from and attached with a fastener 24 at an upper end of the backboard 14 as seen in the Figures, or alternatively formed as one piece with the backboard 14 if the backboard is made of a plastic or polymer material. Support 16 extends at an approximate right angle from the backboard 14 as seen in FIG. 2, and extends a sufficient distance to allow the grip 12 to loosely hang on the backboard 14. In one embodiment the upper support 16 has a cylindrical form like a post attached to the backboard 14 jutting away therefrom at an approximate ninety degree angle. The distal end 26 of the upper support, also referred to in this embodiment as the post 16, includes an arm 20 pivotally attached to the post 16, and constructed to swivel in an up and down direction as shown by the arrows in FIGS. 1 and 2, and not side to side. The movement of arm 20 is further illustrated in phantom line in FIGS. 2 and 4. The arm 20 can swivel approximately one hundred eighty degrees in an up and down or vertical direction on the backboard 14. Arm 20 movably fits within a channel 28 at the distal end 26 of post 16. Side pins 30 on arm 20 disposed in a cross passage 32 in the end of post 16 hold arm 20 in channel 28 and allow for the pivotal movement of arm 20. Arm 20 should be capable of at least pivoting at approximately ninety degrees from the backboard 14 for the grip 12 to swing away from the backboard 14 as seen in FIG. 1 to allow one to hold the grip. If desired, one can make arm 20 capable of pivoting in a side to side direction, but for the purpose of allowing one to hold the grip for feel and viewing the grip for closer examination, the grip only needs to be pivoted in a vertical or up and down direction. Naturally, arm 20 may pivot to as great an extent as desired. Arm 20 which is movably secured within channel 28 of post 16 has a sufficient length and diameter for entering into aperture 12*a* of the grip 12 and loosely engage and secure grip 12 thereon. The arm 20 may range in length from approximately one to two centimeters, or longer if desired, for holding and retaining the grip 12 when it is swung away from backboard 14 Arm 20 has preferably a cylindrical shape and a diameter sized to slide easily within the aperture 12*a* in the butt end of the grip 12. When diameter of arm 20 is slightly less than the diameter of aperture 12*a*, grip 12 can rotate thereon for better viewing of the grip. Arm 20 preferably includes one or more spaced annular rounded ridges 34 at the far end 36 of arm 20. The ridges 34 should be capable of sliding into aperture 12*a* with some difficulty, because the ridges 34 facilitate retention of the grip 12 on arm 20. When the grip 12 is swung away from backboard 14 and being examined by a prospective customer, the plurality of spaced annular rounded ridges 34 prevent the grip from simply sliding off the arm.

Figure 5:
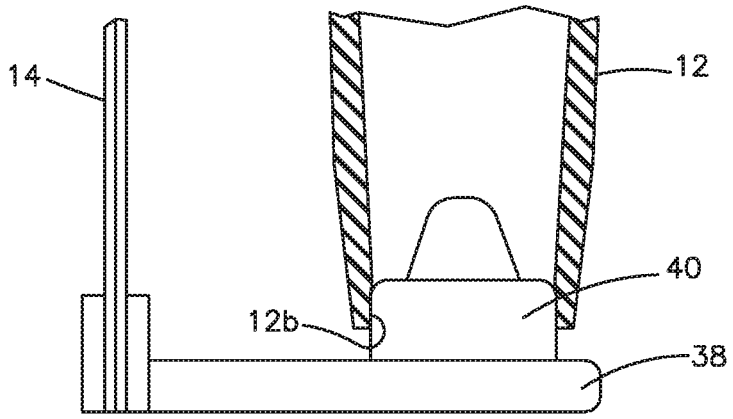
FIG. 5 is a partial sectional side view of the lower portion of the interactive display grip holder with a partial sectional side view of the lower end portion of the golf club grip according to the present disclosure.

The opening 12*b* in the lower end of grip 12 rests on lower support 18 to keep the grip in place in the interactive display holder 10 as seen in FIG. 1 resting in phantom line against the backboard 14. Lower support 18 may be separate from and attached at a lower end of the backboard 14 with a fastener 24, or alternatively formed as one piece with the backboard 14 when the backboard is made from a plastic or polymer material. The lower support 18 in one embodiment includes a base 38 at the bottom of the backboard 14 with a cylindrical or conical portion or a pedestal nub 40 positioned on the base 38 and being constructed to receive the opening 12*b* from the shaft end of the grip 12 as best seen in FIG. 5. The pedestal nub 40 is positioned approximately in alignment with arm 20 so that the grip 12 can hang from arm 20 and rest on pedestal nub 40. As seen in FIG. 5, pedestal nub 40 may have a conical shape sized to fit within opening 12*b* with its cylindrical portion supporting the grip 12 at its shaft end. The pedestal nub 40 keeps the grip 12 from swinging around when hanging on the interactive display holder.

The post 16, arm 20, hook 22, fastener 24, base 38, and pedestal nub 40 can be made of a plastic material or a polymer, or any suitable material that allows them to function as described, and attached to the backboard 14 with suitable fasteners made from a like material or any suitable material.

The interactive display grip holder 10 according to the present disclosure allows a prospective customer to not only swing the putter grip away from the backboard for evaluating its grip feel but also to carefully examine the entire grip without opening a box or tearing open a package. The customer can remove the holder 10 from where it hangs, flex the shaft end of the putter grip to move it off of the pedestal nub 40, and swing the grip away from the backboard 14 using arm 20. The customer can place both hands on the grip 12 for evaluating the grip. After evaluating the grip, the customer simply swings the grip 12 back against the backboard 14, flexes the grip 12 to slip the open end 12*b* of the grip 12 back onto pedestal nub 40, and then hang the holder 10 back on the display rack (not shown). In this manner, the present disclosure allows the prospective customer the opportunity to interact with the merchandise without disturbing the presentation or display of the merchandise for the merchant.

While the present disclosure made particular reference to a golf club grip, namely, a putter grip, it should be immediately apparent that the present disclosure can find applicability to any type of slip-on grip used for tools, or handle bars for sports vehicles, or other sporting implements using a hand grip, and should not be construed to be only limited to golf club grips.

While specific embodiments of the invention have been shown and described in detail to illustrate the application of the principles of the disclosure, it will be understood that the disclosure may be embodied otherwise without departing from such principles.

I claim:

1. An interactive display holder for a grip, comprising:

a backboard extending lengthwise for receiving a grip, said backboard having an upper end for receiving a butt end of a grip and a lower end for receiving a shaft end of the grip;

a lower support attached at the lower end of said backboard, said lower support having a cylindrical portion constructed to receive an opening in the shaft end of the grip, said lower support releasably holding the grip at the shaft end of the grip on said backboard; and an upper support attached at the upper end of said backboard and extending from said backboard, said upper support having an arm movably attached to said upper support, said arm being constructed to releasably engage an aperture in the butt end of the grip and move the butt end of the grip from the backboard.

2. An interactive display holder for a grip as defined in claim 1, wherein said upper support comprises a post extending transversely from said backboard, said arm being pivotally attached to said post and being approximately aligned with said cylindrical portion of said lower support.

3. An interactive display holder for a grip as defined in claim 2, wherein said lower support comprises a base having the cylindrical portion attached to said backboard, said cylindrical portion of said base, being approximately aligned with said arm attached to said post.

4. An interactive display holder for a grip as defined in claim 3, wherein said base, said post, said cylindrical portion, and said arm are comprised of plastic material.

5. An interactive display holder for a grip as defined in claim 4, wherein said arm further comprises at least one annular ridge at one end engaging the aperture of the grip for releasably securing the butt end of the grip to said arm.

6. An interactive display holder for a grip as defined in claim 5, wherein said arm further comprises a plurality of annular spaced ridges at the end engaging the aperture of the grip for releasably securing the butt end of the grip to said arm.

7. An interactive display holder for a grip as defined in claim 1, further comprising a hook attached to an uppermost end of said backboard for hanging the holder and grip for display.

8. An interactive display holder for a golf club grip, comprising:

a backboard extending lengthwise for receiving a golf club grip;

a lower support for receiving a shaft end of the golf club grip attached to said backboard, said lower support having a base with a cylindrical portion constructed to receive an opening in the shaft end of the golf club grip, said lower support releasably holding the golf club grip at the shaft end of the golf club grip on said backboard; and an upper support for receiving a butt end of the golf club grip attached to said backboard, said upper support having an arm movably attached to said upper support, said arm being constructed to releasably engage an aperture in the butt end of the golf club grip.

9. An interactive display holder for a golf club grip as defined in claim 8, wherein said upper support comprises a post extending transversely from said backboard, said arm movably attached to said post being approximately aligned with said cylindrical portion of said lower support.

10. An interactive display holder for a golf club grip as defined in claim 9, wherein said base of said lower support is attached at approximately a right angle to said backboard, said base with the cylindrical portion being approximately aligned with said arm movably attached to said post.

11. An interactive display holder for a golf club grip as defined in claim 10, wherein said arm further comprises at least one annular ridge at one end engaging the aperture of the golf club grip for releasably securing the butt end of the golf club grip to said arm.

12. An interactive display holder for a golf club grip as defined in claim 11, wherein said arm further comprises a plurality of annular spaced ridges at the end engaging the aperture of the golf club grip for releasably securing the butt end of the golf club grip to said arm.

13. An interactive display holder for a golf club grip as defined in claim 12, further comprising a hook attached to the uppermost end of said backboard for hanging the holder and golf club grip for display.

14. An interactive display holder for a golf club grip as defined in claim 13, wherein said arm movably attached to said post swivels in an up and down direction.

15. An interactive display holder for a golf club grip as defined in claim 14, wherein said hook, said base, said cylindrical portion, said post, and said arm are comprised of plastic material.

16. An interactive display holder for a golf club grip as defined in claim 15, wherein said backboard comprises a cardboard material.

17. An interactive display holder for a golf club grip as defined in claim 16, wherein the golf club grip is a putter grip.

18. A method for displaying a golf club grip, comprising the steps of:

providing a backboard for receiving a golf club grip, the backboard having an upper end for receiving a butt end of the golf club grip and a lower end for receiving a shaft end of the golf club grip;

attaching an upper support to the upper end of the backboard;

attaching a lower support having a cylindrical portion to the lower end of the backboard;

providing a swivel arm in the upper support for releasably engaging an aperture in the butt end of the golf club grip; and supporting the shaft end of the golf club grip with the cylindrical portion of the lower support receiving an opening in the shaft end of the golf club grip.

19. A method as recited in claim 18, wherein the golf club grip is a putter grip.

20. A method as recited in claim 18, further comprising the step of hanging the backboard for vertically displaying the golf club grip.

* * * * *